US006198463B1

(12) United States Patent
Ito et al.

(10) Patent No.: US 6,198,463 B1
(45) Date of Patent: Mar. 6, 2001

(54) METHOD FOR DRIVING AC-TYPE PLASMA DISPLAY PANEL

(75) Inventors: Yukiharu Ito; Takao Wakitani, both of Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/158,310

(22) Filed: Sep. 22, 1998

(30) Foreign Application Priority Data

Sep. 30, 1997 (JP) ..... 9-267237

(51) Int. Cl.[7] ..... G09G 3/28

(52) U.S. Cl. ..... 345/60; 345/66; 345/67; 345/68

(58) Field of Search ..... 345/60, 66, 67, 345/68

(56) References Cited

U.S. PATENT DOCUMENTS 5,420,602 * 5/1995 Kanazawa ..... 345/67
5,446,344 * 8/1995 Kanazawa ..... 315/169.4
5,583,527 * 12/1996 Fujisaki et al. ..... 345/55
5,889,501 * 3/1999 Sasaki et al. ..... 345/60
6,034,482 * 3/2000 Kanazawa et al. ..... 315/169

FOREIGN PATENT DOCUMENTS 0 157 248 A2 10/1985 (EP) .
0 337 833 A1 10/1989 (EP) .
2 744 276 A1 8/1997 (FR) .

* cited by examiner

*Primary Examiner*—Richard A. Hjerpe
*Assistant Examiner*—Henry N. Tran
(74) *Attorney, Agent, or Firm*—Sheridan Ross P.C.

(57) ABSTRACT

In a method of driving an AC-type plasma display panel in which a first insulation substrate and a second insulation substrate are disposed so as to be opposed to each other, pairs of scanning electrodes and sustaining electrodes covered with a dielectric layer and a protective layer are arranged on the first insulation substrate and at least data electrodes are arranged on the second insulation substrate so as to be orthogonal to the pairs of scanning and sustaining electrodes, immediately after termination of application of a sustaining pulse voltage to one of the scanning electrodes and the sustaining electrodes, the sustaining pulse voltage is applied to the other.

2 Claims, 8 Drawing Sheets

METHOD FOR DRIVING AC-TYPE PLASMA DISPLAY PANEL

BACKGROUND OF THE INVENTION

The present invention relates to a method for driving a plasma display panel for use in image display of televisions, computers, and the like.

FIG. 5 is a partially cutaway perspective view of a conventional AC-type plasma display panel (hereinafter, abbreviated as panel). In the figure, a plurality of pairs of parallelly disposed scanning electrodes $SCN_1$ to $SCN_N$ and sustaining electrodes $SUS_1$ to $SUS_N$ are formed on the bottom surface of a first insulation substrate 1, and covered with a dielectric layer 2 and a protective layer 3. Data electrodes $D_1$ to $D_M$ are formed on a second insulation layer 6 provided opposing to the first insulation substrate 1. Partition ribs 8 are provided between the adjoining data electrodes $D_1$ to $D_M$ so as to be parallel to the data electrodes $D_1$ to $D_M$. A phospher 9 (shown only partly) is provided on the surfaces of the data electrodes $D_1$ to $D_M$. The first insulation substrate 1 and the second insulation substrate 6 are opposed to each other with a discharge space 10 therebetween so that the data electrodes $D_1$ to $D_M$ are orthogonally aligned to the scanning electrodes $SCN_1$ to $SCN_N$ and the sustaining electrodes $SUS_1$ to $SUS_N$. An image is displayed by sustaining discharge between the scanning electrode $SCN_i$ and the sustaining electrode $SUS_i$ that are paired with each other ("i" is an arbitrary number among 1 to N).

FIG. 6 is a view showing an electrode arrangement of this panel. The electrode arrangement of this panel is a matrix with M columns and N rows. M columns of data electrodes $D_1$ to $D_M$ are arranged in the column direction, and N rows of scanning electrodes $SCN_1$ to $SCN_N$ and sustaining electrodes $SUS_1$ to $SUS_N$ are arranged in the row direction.

Hereafter, description is made as to operation of the conventional AC-type plasma display panel. Although not shown, a pulse generator is provided for each of the sustaining electrodes SUS, the scanning electrodes SCN and the data electrodes D, and the output terminal of each pulse generator is connected to the corresponding electrode so that a pulse voltage is applied to the electrode. Respective ground terminals of the pulse generators are connected to a common terminal, and a voltage of difference among the output voltages of the pulse generators is applied to the sustaining electrodes SUS, the scanning electrodes SCN and the data electrodes D. FIG. 7 is a timing chart in the driving operation. In FIG. 7, first, during a writing period, all the sustaining electrodes $SUS_1$ to $SUS_N$ are held at 0(V) ((V) represents volt). A positive writing pulse voltage $+V_W(V)$ is applied to a predetermined one of the data electrodes $D_1$ to $D_M$ (hereinafter, referred to as predetermined data electrode $D_1$–$D_M$), and a negative scanning pulse voltage $-V_S(V)$ is applied to the first scanning electrode $SCN_1$. Consequently, writing discharge occurs at the intersection of the predetermined data electrode $D_1$–$D_M$ and the first scanning electrode $SCN_1$, and a positive charge accumulates on the surface of the protective layer 3 on the first scanning electrode $SCN_1$ at the intersection. Then, the positive writing pulse voltage +Vw(V) is applied to another predetermined data electrode $D_1$–$D_M$, and the negative scanning pulse voltage $-V_S(V)$ is applied to the second scanning electrode $SCN_2$. Consequently, writing discharge occurs at the intersection of the predetermined data electrode $D_1$–$D_M$ and the second scanning electrode $SCN_2$, and a positive charge accumulates on the surface of the protective layer 3 on the second scanning electrode $SCN_2$ at the intersection. Similar scanning operations are continuously performed, and lastly, the positive writing pulse voltage $+V_W(V)$ is applied to still another predetermined data electrode $D_1$–$D_M$, and the negative scanning pulse voltage $-V_S(V)$ is applied to the N-th scanning electrode $SCN_N$. Consequently, writing discharge occurs at the intersection of the predetermined data electrode $D_1$–$D_M$ and the N-th scanning electrode $SCN_N$, and a positive charge accumulates on the surface of the protective layer 3 on the N-th scanning electrode $SCN_N$ at the intersection.

Then, during a sustaining period, first, a negative sustaining pulse voltage −Vm(V) is applied to all the sustaining electrodes $SUS_1$ to $SUS_N$, so that sustaining discharge starts between the scanning electrodes $SCN_1$ to $SCN_N$ and the sustaining electrodes $SUS_1$ to $SUS_N$ at the intersections where writing discharge occurred. Then, after a period T from the termination of the negative sustaining pulse voltage −Vm(V) applied to the sustaining electrodes $SUS_1$ to $SUS_N$, the negative sustaining pulse voltage −Vm(V) is applied to all the scanning electrodes $SCN_1$ to $SCN_N$. Consequently, sustaining discharge again occurs between the scanning electrodes $SCN_1$ to $SCN_N$ and the sustaining electrodes $SUS_1$ and $SUS_N$ at the intersections where writing discharge occurred. The words "termination of a pulse voltage" means a point of time when the rising edge of the pulse voltage reaches 0(V). Further, after the period T from the termination of the negative sustaining pulse voltage −Vm(V) applied to the scanning electrodes $SCN_1$ to $SCN_N$, the negative sustaining pulse voltage −Vm(V) is applied to all the sustaining electrodes $SUS_1$ to $SUS_N$. Consequently, sustaining discharge further occurs between the scanning electrodes $SCN_1$ to $SCN_N$ and the sustaining electrodes $SUS_1$ to $SUS_N$ at the intersections where writing discharge occurred. By applying the negative sustaining pulse voltage −Vm( V) alternately to all the scanning electrodes $SCN_1$ to $SCN_N$ and to all the sustaining electrodes $SUS_1$ to $SUS_N$ at intervals of the period T in a like manner, sustaining discharge continuously occurs. Light emitted by this sustaining discharge is used for display. The waveform of the negative sustaining pulse voltage −Vm(V) is trapezoidal as shown in FIG. 8 because it takes a predetermined time for the voltage to rise or fall.

Lastly, during an erasing period, a positive narrow time-width erasing pulse voltage −Ve(V) is applied to all the sustaining electrodes $SUS_1$ to $SUS_N$, so that erasing discharge occurs. This stops the discharge. By the above-described operation, an image is displayed on the AC-type plasma display panel.

In the sustaining pulse voltage alternately applied to the scanning electrodes $SCN_1$ to $SCN_N$ and to the sustaining electrodes $SUS_1$ to $SUS_N$, it is conventionally considered that after the period T from termination of the application of the sustaining pulse voltage to one of the scanning electrode and the sustaining electrode, the sustaining pulse voltage must be applied to the other electrode. The period T is normally set to 0.5 microsecond or longer. In the above-described conventional panel, the period T is 0.5 microsecond.

In the above-described sustaining discharge operation, during the period T, sustaining discharge necessary for display occurs between the scanning electrodes $SCN_1$ to $SCN_N$ and the sustaining electrodes $SUS_1$ to $SUS_N$. The invertors of the present invention found that erroneous discharge not contributing to display also occurs between the data electrodes $D_1$ to $D_M$ and the scanning electrodes $SCN_1$ to $SCN_N$ or between the data electrodes $D_1$ to $D_M$ and the sustaining electrodes $SUS_1$ to $SUS_N$ in concurrence with occurrence of the sustaining discharge. This was confirmed from a current flowing through the data electrodes $D_1$ to $D_M$ during the sustaining period. The erroneous discharge weakens the sustaining discharge, so that the sustaining discharge stops or becomes unstable. Further, since current flows through the data electrodes $D_1$ to $D_M$ because of the erroneous discharge, ions generated during the erroneous discharge have an impact on the phospher. This deteriorates the phospher, so that the luminance of the sustaining discharge significantly decreases. These two have been problems to be solved.

BRIEF SUMMARY OF THE INVENTION

An object of the present invention is to improve a method for driving an AC-type plasma display panel in which a first insulation substrate and a second insulation substrate are arranged in opposed relationship, at least one pair of scanning and sustaining electrodes covered with a dielectric layer and a protective layer are arranged on the first insulation substrate and at least data electrodes are arranged on the second insulation substrate so as to be orthogonal to the scanning and sustaining electrodes.

The method for driving an AC-type plasma display panel according to the present invention is characterized that, in a sustaining discharge operation for sustaining discharge for display by repetitively alternately applying a sustaining pulse voltage to the scanning electrode and the sustaining electrode that are paired with each other, immediately after termination of the application of the sustaining pulse voltage to one of the scanning electrode and the sustaining electrode, the sustaining pulse voltage is applied to the other sustaining electrode.

A large potential difference is generated across the data electrode and the protective layer in a time period between termination of application of the sustaining pulse voltage to one of the sustaining electrode and scanning electrode and start of application of next sustaining pulse voltage to the other. Erroneous discharge occurs due to the potential difference. This potential difference is rapidly decreased by application of the next sustaining pulse voltage to the other. When the next sustaining pulse voltage is applied to the other immediately after termination of application of the first sustaining pulse voltage, the potential difference across the protective layer and the data electrode immediately decreases, and therefore the erroneous discharge does not occur.

Another method for driving an AC-type plasma display panel according to the present invention is characterized that in the above-mentioned method, after termination of the application of the sustaining pulse voltage to one of the scanning electrode and the sustaining electrode, the sustaining pulse voltage is applied to the other within 0.3 microsecond.

In the above-mentioned another method for driving the AC-type plasma display panel according to the present invention, within 0.3 microsecond after termination of the application of the sustaining pulse voltage to one of the scanning electrode and the sustaining electrode, the sustaining pulse voltage is applied to the other. Consequently, erroneous discharge does not occur during the sustaining discharge operation, so that stable sustaining discharge is realizable. As a result, stable display which has no flicker due to un-lighting can be obtained. Moreover, since it never occurs that ions have an impact on the phospher, an AC-type plasma display panel can be realized in which the luminance of sustaining discharge never decreases.

DETAILED DESCRIPTION OF THE INVENTION

Figure 5:
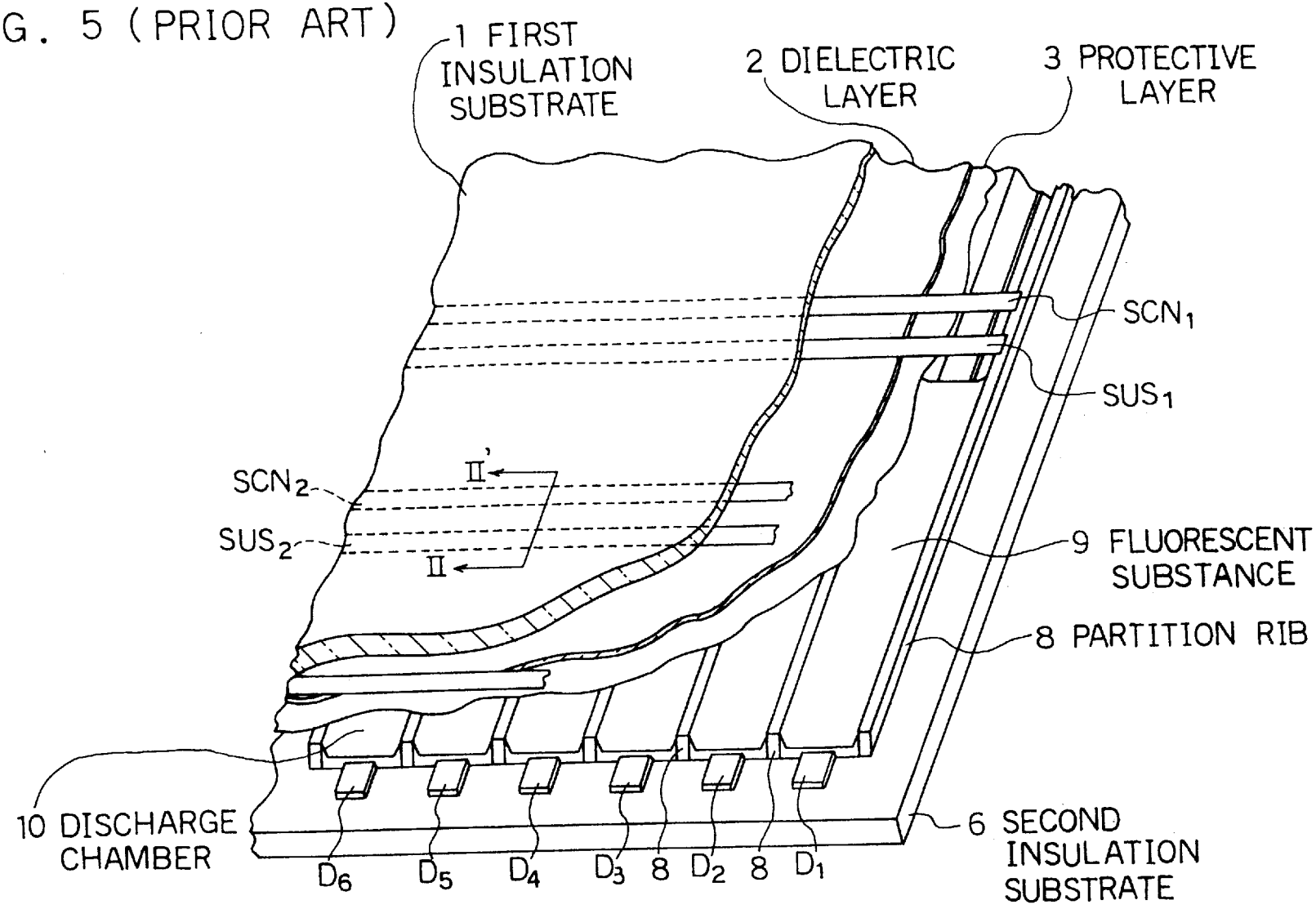
FIG. 5 (PRIOR ART)
FIG. 5 is the partially cutaway perspective view showing the structure of the AC-type plasma display panel used both in the prior art and the present invention.
Figure 6:
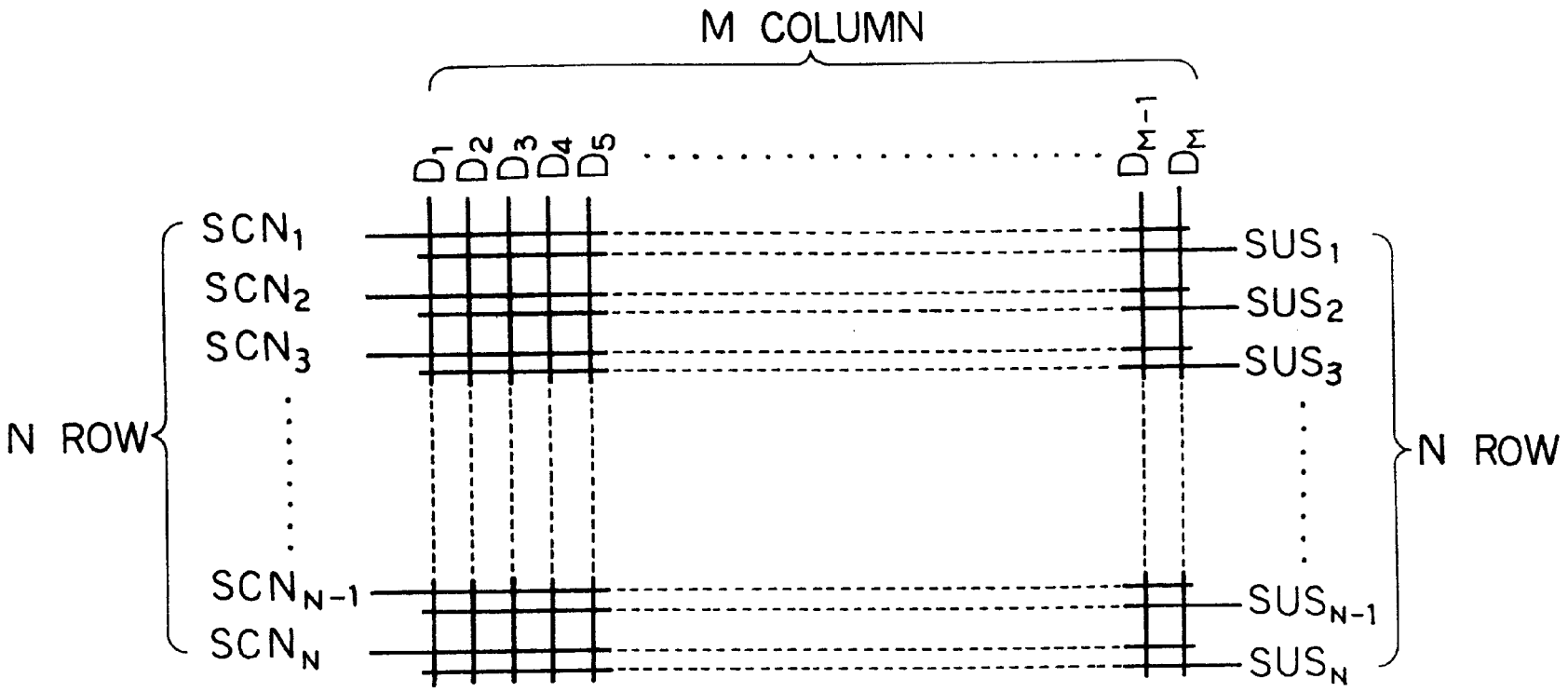
FIG. 6 (PRIOR ART)
FIG. 6 is the view showing the electrode arrangement of the AC-type plasma display panel shown in FIG. 5.
Figure 7:
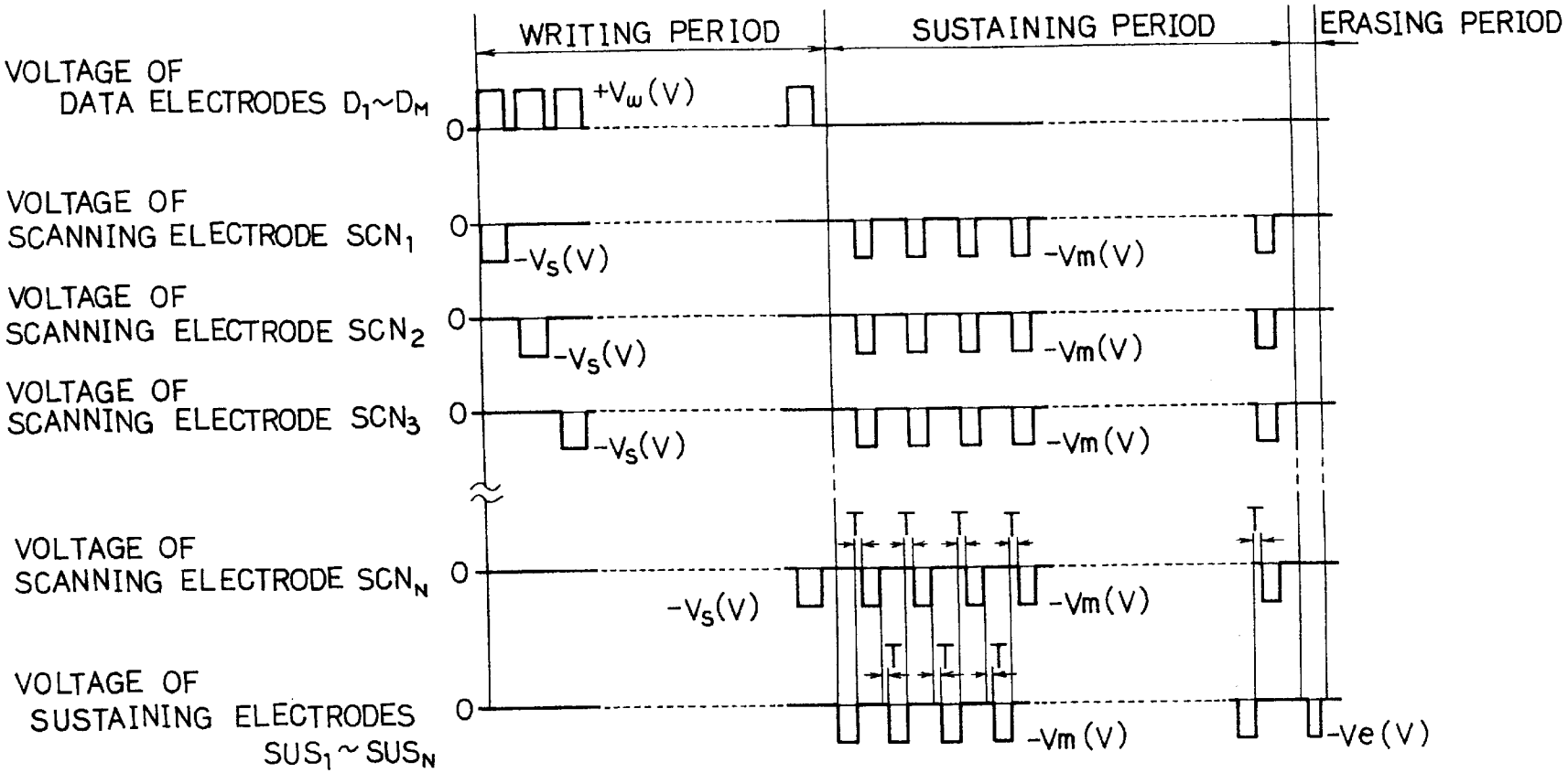
FIG. 7 (PRIOR ART)
FIG. 7 is the operation driving timing chart showing the conventional AC-type plasma display panel driving method.
Figure 8:
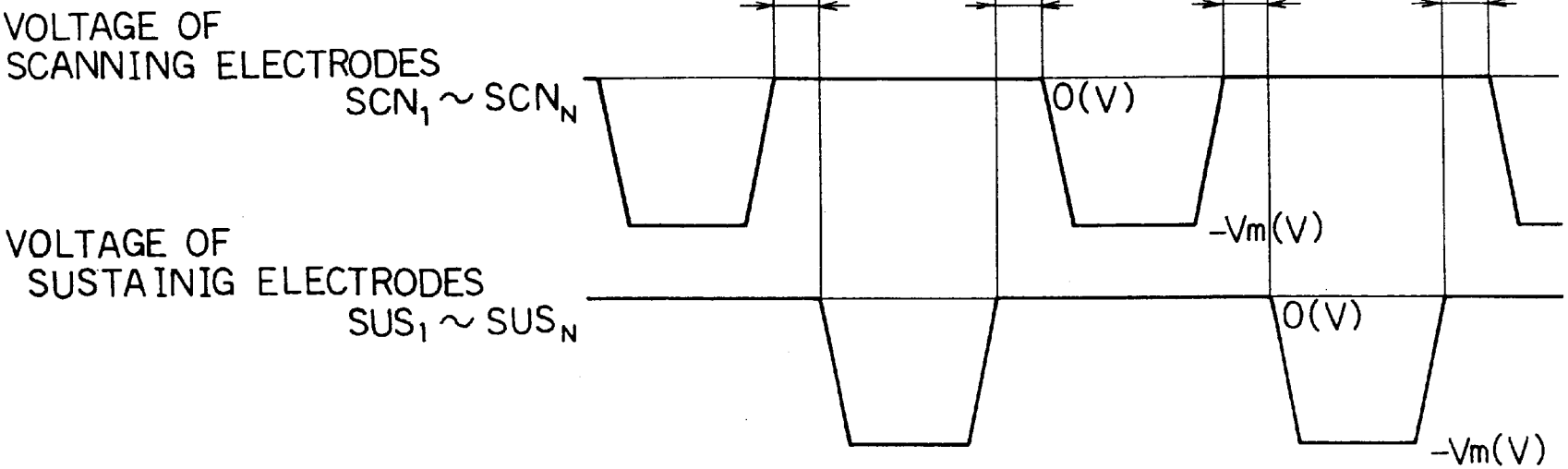
FIG. 8 (PRIOR ART)
FIG. 8 is the waveform chart of the sustaining pulse voltage in the conventional driving method.

The structure of an AC-type plasma display panel (hereinafter, abbreviated as panel) operated with a driving method of the present invention is the same as that shown in FIG. 5 explained in the description of the prior art. The electrode arrangement of this panel is the same a s that shown in FIG. 6. Therefore, no overlapping descriptions will be given with respect to the structure and the electrode arrangement of the panel.

Figure 1:
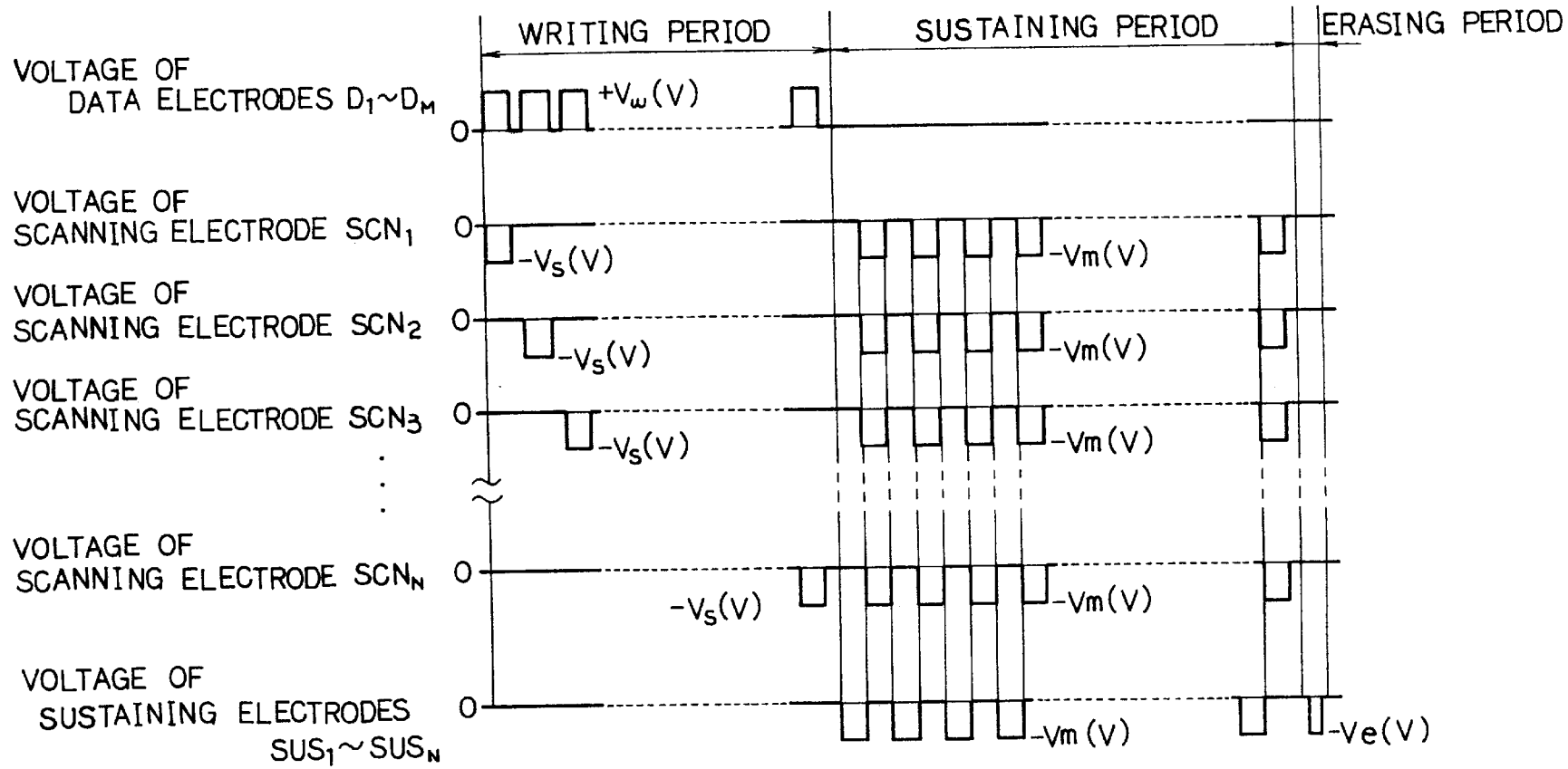
FIG. 1 is an operation driving timing chart showing a method for driving an AC-type plasma display panel as an embodiment of the present invention.

Hereinafter, the method of driving an AC-type plasma display panel according to a preferred embodiment of the present invention will be described with reference to FIG. 1 to FIG. 4. FIG. 1 is a timing chart of driving operation. The driving operation period includes a writing period, a sustaining period and an erasing period.

In FIG. 1, first, during the writing period, all the sustaining electrodes $SUS_1$ to $SUS_N$ are held at 0(V) ((V) represents volt), and a positive writing pulse voltage $+V_W(V)$ is applied to a predetermined one of the data electrodes $D_1$ to $D_M$ (hereinafter, referred to as predetermined data electrode $D_1$–$D_M$). Further, a negative scanning pulse voltage $-V_S(V)$ is applied to the first scanning electrode $SCN_1$. Consequently, writing discharge occurs at the intersection of the predetermined data electrode $D_1$–$D_M$ and the first scanning electrode $SCN_1$, and a positive charge accumulates on the surface of the protective layer 3 on the first scanning electrode $SCN_1$ at the intersection. Then, the positive writing pulse voltage $+V_W(V)$ is applied to another predetermined data electrode $D_1$–$D_M$, and the negative scanning pulse voltage $-V_S(V)$ is applied to the second scanning electrode $SCN_2$. Consequently, writing discharge occurs at the intersection of the predetermined data electrode $D_1$–$D_M$ and the second scanning electrode $SCN_2$, and a positive charge accumulates on the surface of the protective layer 3 on the second scanning electrode $SCN_2$ at the intersection. The above-mentioned scanning driving operation is continuously performed in a like manner, and lastly, the positive writing pulse voltage $+V_W(V)$ is applied to still another predetermined data electrode $D_1$–$D_M$, and the negative scanning pulse voltage $-V_S(V)$ is applied to the N-th scanning electrode $SCN_N$. Consequently, writing discharge occurs at the intersection of the predetermined data electrode $D_1$–$D_M$ and the N-th scanning electrode $SCN_N$, and a positive charge accumulates on the surface of the protective layer 3 on the N-th scanning electrode $SCN_N$ at the intersection.

Then, during the sustaining period, first, the negative sustaining pulse voltage −Vm(V) is applied to all the sustaining electrodes $SUS_1$ to $SUS_N$. Consequently, sustaining discharge starts between the scanning electrodes $SCN_1$ to $SCN_N$ and the sustaining electrodes $SUS_1$ to $SUS_N$ at the intersections where writing discharge occurred. Immediately after the termination of application of the negative sustaining pulse voltage −Vm(V) to the sustaining electrodes $SUS_1$ to $SUS_N$, the negative sustaining pulse voltage −Vm(V) is applied to all the scanning electrodes $SCN_1$ to $SCN_N$. Consequently, sustaining discharge again occurs between the scanning electrodes $SCN_1$ to $SCN_N$ and the sustaining electrodes $SUS_1$ and $SUS_N$ at the intersections where writing discharge occurred. As a time length $T_1$ from time $t_4$ to $t_5$ represented by the above-mentioned phrase "immediately after the termination of application", for example, approximately 100 nanoseconds is appropriate. This time length $T_1$ can be selected from 50 nanoseconds to 0.3 microseconds. In this case, the sustaining pulse voltage is applied to the scanning electrodes $SCN_1$ to $SCN_N$ after approximately 100 nanoseconds from the termination of application of the sustaining pulse voltage to the sustaining electrodes $SUS_1$ to $SUS_N$. By the time length $T_1$ being approximately 100 nanoseconds, sufficient effect for preventing erroneous discharge is obtained. Further, immediately after the termination of application of the negative sustaining pulse voltage −Vm(V) to the scanning electrodes $SCN_1$ to $SCN_N$, the negative sustaining pulse voltage −Vm(V) is applied to all the sustaining electrodes $SUS_1$ to $SUS_N$. Consequently, sustaining discharge again occurs between the scanning electrodes $SCN_1$ to $SCN_N$ and the sustaining electrodes $SUS_1$ to $SUS_N$ at the intersection where writing discharge occurred. By alternately applying the negative sustaining pulse voltage −Vm(V) to all the scanning electrodes $SCN_1$ to $SCN_N$ and to all the sustaining electrodes $SUS_1$ to $SUS_N$ in a like manner, sustaining discharge continuously occurs. Light emitted by this sustaining discharge is used for display.

Then, during the erasing period, the negative narrow time-width erasing pulse voltage −Ve(V) is applied to all the sustaining electrodes $SUS_1$ to $SUS_N$, so that erasing discharge occurs. This stops the discharge. By the above-described operation, one image is displayed on the AC-type plasma display panel.

A feature of the present invention is that immediately after termination of the application of the sustaining pulse voltage to one of the scanning electrodes $SCN_1$ to $SCN_N$ and the sustaining electrode $SUS_1$ to $SUS_N$, the sustaining pulse voltage is applied to the other. By applying the voltage in this manner, sustaining discharge surely occurs only between the scanning electrodes $SCN_1$ to $SCN_N$ and the sustaining electrodes $SUS_1$ to $SUS_N$, and no erroneous discharge occurs between the data electrodes $D_1$ to $D_M$ and the scanning electrode $SCN_1$ to $SCN_N$ or the sustaining electrodes $SUS_1$ to $SUS_N$.

Figure 2:
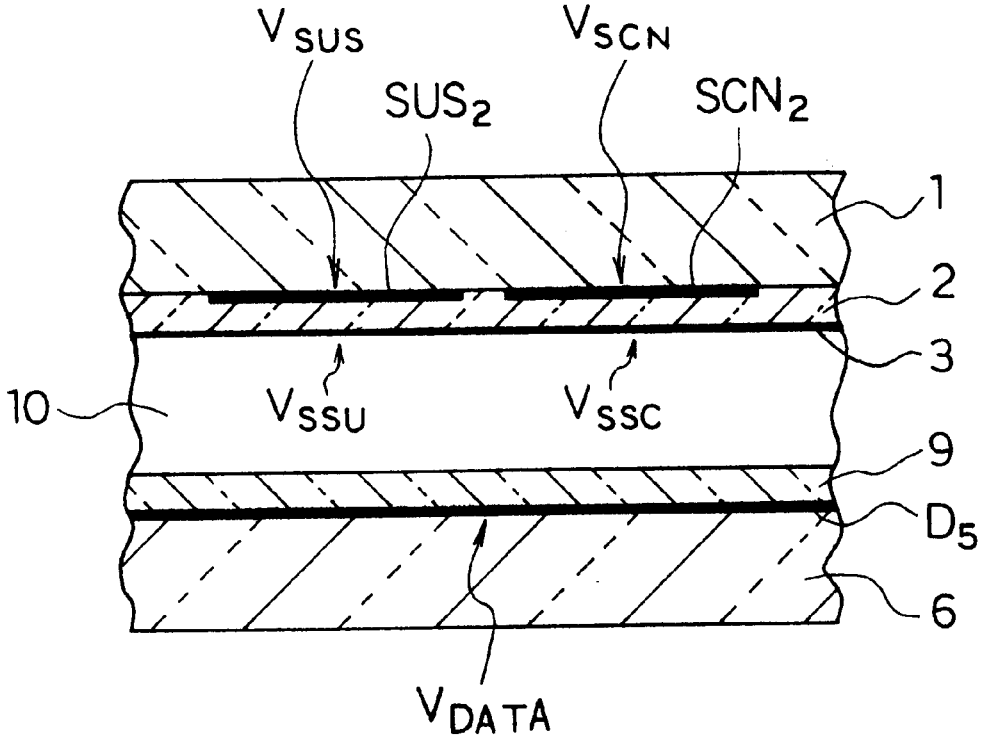
FIG. 2 is a cross-sectional view taken on the line II–II' of FIG. 5.

The inventor's observation of actual panel operation has shown that there is a correlation between the occurrence of the erroneous discharge and the time length of the period T from the end of application of the sustaining pulse voltage at one electrode to the start of application at the other electrode. To consider this, the invertors measured the potential of the wall (hereinafter, referred to as wall potential) due to the charge of the wall (hereinafter, referred to as wall charge) accumulating in the protective layer 3 above the scanning electrode $SCN_2$ and the sustaining electrode $SUS_2$, when the sustaining pulse voltage is applied in FIG. 5. FIG. 2 is a cross-sectional view taken on the line II–II' of FIG. 5. In FIG. 2, the potentials of the scanning electrode $SCN_2$ the sustaining electrode $SUS_2$ and the data electrode $D_5$ are designated as $V_{SCN}$, $V_{SUS}$ and $V_{DATA}$, respectively. The wall potential of a portion of the protective layer 3 opposed to the scanning electrode $SCN_2$ is designated as $V_{SSC}$, and the wall potential of a portion of the protective layer 3 opposed to the sustaining electrode $SUS_2$ is designated as $V_{SSU}$. Variation of these potentials in the sustaining discharge operation is shown in FIG. 3.

Figure 3:
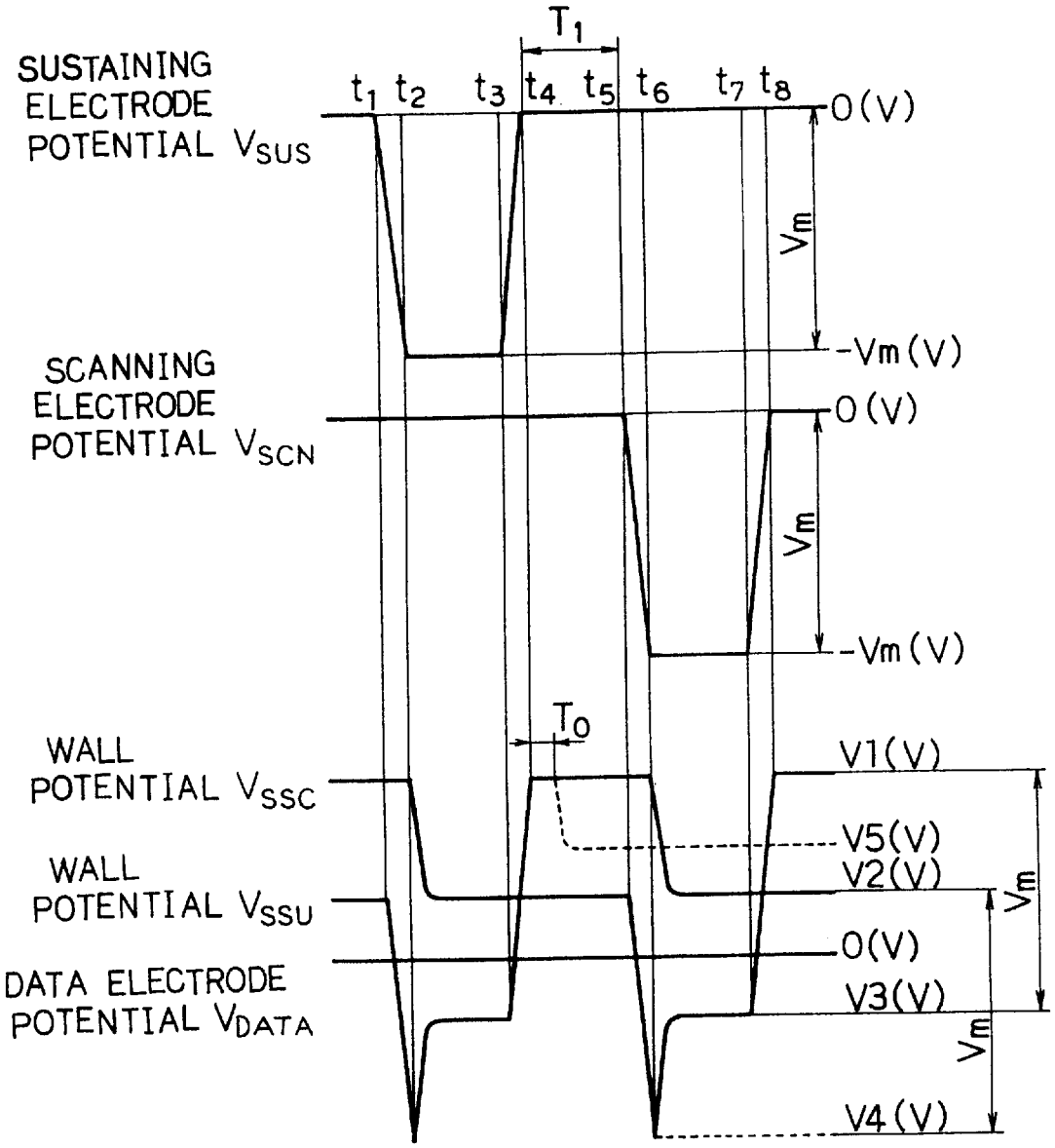
FIG. 3 is a timing chart showing wall potential variation in a sustaining discharge operation.

In the case of FIG. 3, immediately before a time $t_1$ when the application of the sustaining pulse voltage is started, the potential $V_{SUS}$ of the sustaining electrode $SUS_2$ is 0(V), the potential $V_{SCN}$ of the scanning electrode $SCN_2$ is 0(V), and the wall potentials $V_{SSC}$ and $V_{SSU}$ are V1(V) and V2(V), respectively. During the period from the time $t_1$ to a time $t_2$, when the potential $V_{SUS}$ of the sustaining electrode $SUS_2$ changes from 0(V) to −Vm(V), the wall potential $V_{SSC}$ remains V1(V) and the wall potential $V_{SSU}$ changes from V2(V) to V4(V). The potential V4(V) is lower than the potential V2(V) by the potential Vm(V). Therefore, the potential difference between the wall potentials $V_{SSC}$ and $V_{SSU}$ is as great as (V1−V4)(V) exceeding the discharge start voltage, so that sustaining discharge occurs between the sustaining electrode $SUS_2$ and the scanning electrode $SCN_2$. Concurrently, the wall potential $V_{SSC}$ changes from V1(V) to V2(V) and the wall potential $V_{SSU}$ changes from V4(V) to V3(V). Then, during the period from a time $t_3$ to a time $t_4$, when the potential $V_{SUS}$ of the sustaining electrode $SUS_2$ changes from −Vm(V) to 0(V), the wall potential $V_{SSC}$ remains V2(V) and the wall potential $V_{SSU}$ changes from V3(V) to V1(V). The potential V1(V) is higher than the potential V3(V) by the potential Vm(V). Thereafter, the wall potential $V_{SSU}$ does not change during a period $T_1$ to the application of the next sustaining pulse voltage to the scanning electrode $SCN_2$ (period from the time $T_4$ to a time $T_5$).

During the period from the time $t_5$ to a time $t_6$, when the potential $V_{SCN}$ of the scanning electrode $SCN_2$ changes from 0(V) to −Vm(V), the wall potential $V_{SSU}$ remains V1(V) and the wall potential $V_{SSC}$ changes from V2(V) to V4(V). The potential V4(V) is lower than the potential V2(V) by the potential Vm(V). Therefore, the potential difference between the wall potentials $V_{SSC}$ and $V_{SSU}$ is as great as V1(V)–V4(V) exceeding the discharge start voltage, so that sustaining discharge occurs between the sustaining electrode $SUS_2$ and the scanning electrode $SCN_2$. Consequently, after the time $t_6$, the wall potential $V_{SSU}$ changes from V1(V) to V2(V) and the wall potential $V_{SSC}$ changes from V4(V) to V3(V). Then, during the period from a time $t_7$ to a time $t_8$, when the potential $V_{SCN}$ of the scanning electrode $SCN_2$ changes from −Vm(V) to 0(V), the wall potential $V_{SSU}$ remains V2(V) and the wall potential $V_{SSC}$ changes from V3(V) to V1(V). The potential V1(V) is higher than the potential V3(V) by the potential Vm(V). Thereafter, by alternately applying the pulse voltage to the sustaining electrode $SUS_2$ and the scanning electrode $SCN_2$ in a like manner, sustaining discharge continues and the wall potentials change similarly.

During the period $T_1$ from the termination of application of the sustaining pulse voltage to the sustaining electrode $SUS_2$ to the application of the next sustaining pulse voltage to the scanning electrode $SCN_2$ (the period from the time $t_4$ to the time $t_5$), the potential difference between the wall potential $V_{SSU}$ and the potential $V_{DATA}$ of the data electrode $D_5$ is considerably large and exceeds the voltage at which discharge starts between the sustaining electrode $SUS_2$ and the data electrode $D_5$. Consequently, after a period $T_0$ during which the residual charge of the discharge occurring between the sustaining electrode $SUS_2$ and the scanning electrode $SCN_2$ diffuses in the vicinity of the data electrode $D_5$ opposing in a position away from the electrodes $SUS_2$ and $SCN_2$, not sustaining discharge but erroneous discharge occurs between the sustaining electrode $SUS_2$ and the data electrode $D_5$. As shown by the broken line in FIG. 3, after the period $T_0$ from the time $t_4$, the wall potential $V_{SSU}$ decreases from V1(V) to V5(V) due to the erroneous discharge. Consequently, even though the sustaining pulse voltage is applied to the scanning electrode $SCN_2$ at the time $t_6$, normal discharge does not stably continue but sometimes stops because the wall potential difference V5–V4(V) is smaller than the above-mentioned potential difference V1–V4(V).

From the above description, it is understood that no erroneous discharge occurs when the period $T_1$ (the period from the time $t_4$ to the time $t_5$) is shorter than the period $T_0$. The period $T_1$ is a time period from the termination of application of the sustaining pulse voltage at the sustaining electrode $SUS_2$ to the application of the next sustaining pulse voltage at the scanning electrode $SCN_2$. This holds for the period from the termination of application of the sustaining pulse voltage at the scanning electrode $SCN_2$ to the application of the next pulse voltage at the sustaining electrode $SUS_2$.

Figure 4:
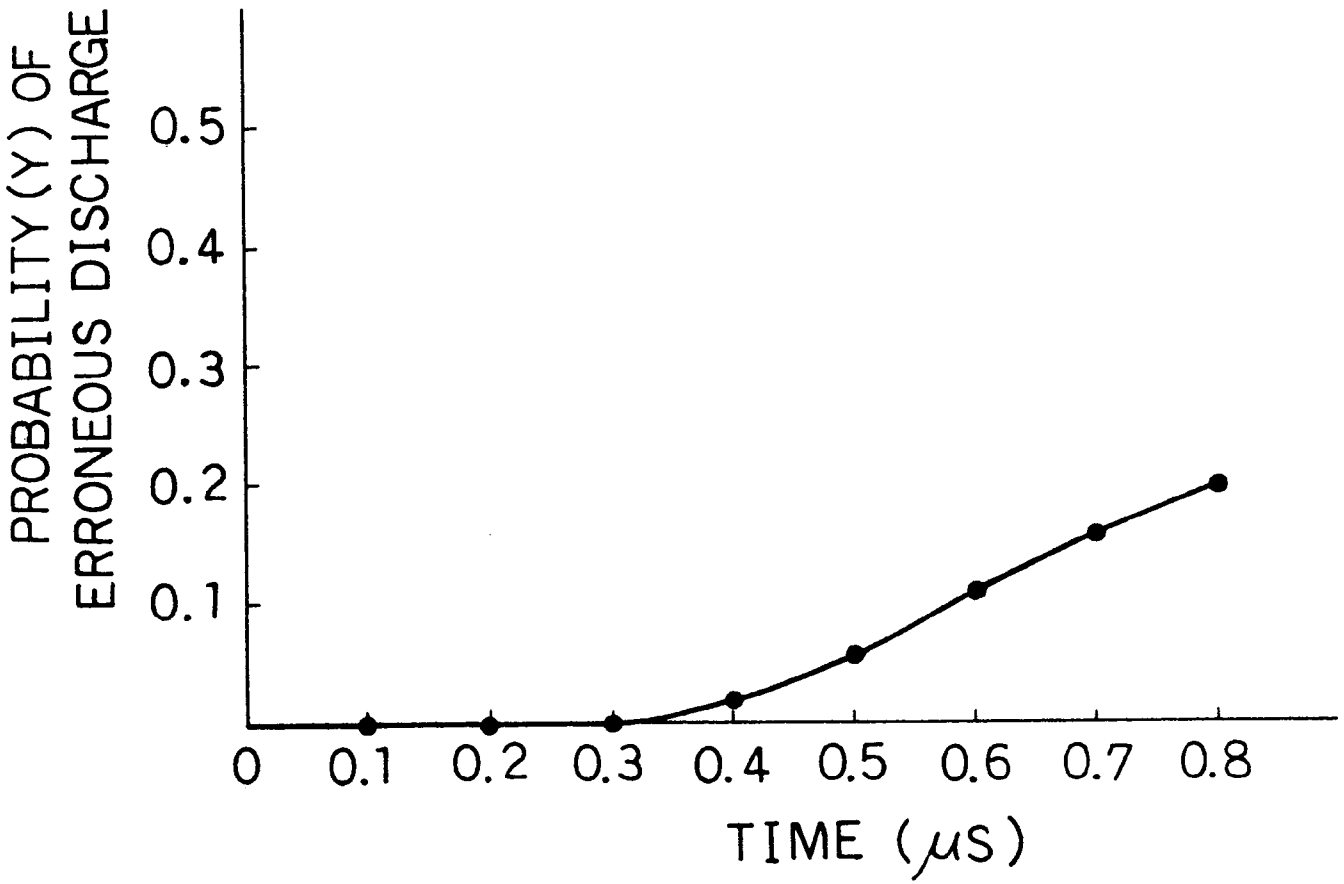
FIG. 4 is a graph showing the probability of erroneous discharge.

The relationship between the period T and a probability Y of occurrence of the erroneous discharge was examined by the invertors by use of a 42-inch AC-type plasma display panel of 640×480 pixels. This relationship is shown in FIG. 4. Here, the probability Y is calculated on the assumption that the value of current flowing through one data electrode during sustaining discharge corresponds to the number of portions of erroneous discharge occurring between the data electrode and 480 pairs of scanning and sustaining electrodes crossing the data electrode. When the number of erroneous discharge occurring portions is "n" and comparatively small, the value of current flowing through the data electrode is represented by i(A) (A represents ampere). When the value of the current flowing through the data electrode is represented by I(A), the probability Y is calculated by $Y=(n/480)\times(I/i)$. From the result shown in FIG. 4, the probability Y of occurrence of the erroneous discharge increases when the time period T is longer than 0.3 microseconds. No erroneous discharge occurs when the period T from the termination of application of the sustaining pulse voltage at one of the electrodes to the application of the next sustaining pulse voltage is 0.3 microseconds or shorter.

From the above description, in the sustaining discharge operation of the panel, the erroneous discharge is prevented by applying the sustaining pulse voltage alternately to the scanning electrode and sustaining electrode with time intervals of from about 50 nanoseconds to 0.3 microseconds. As a result, stable sustaining discharge is obtained, the deterioration of the phospher is prevented and the luminance of sustaining discharge does not decrease.

While the sustaining pulse voltage is a negative pulse voltage in the above description, a driving method using a positive pulse voltage is within the scope of the present invention. The present invention is also applicable to AC-type plasma display panels of other structures.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A method for driving an AC-type plasma display panel comprising:

a first insulation substrate having at least one pair of scanning electrodes and sustaining electrodes which are covered with a dielectric layer and a protective layer, and a second insulation substrate arranged in opposed relationship to said first insulation substrate, having data electrodes orthogonal to said scanning electrodes and sustaining electrodes, wherein, in sustaining discharge operation for sustaining display discharge by applying alternately a sustaining pulse voltage to said scanning electrodes and said sustaining electrodes, within about 50 nanoseconds to about 0.3 microseconds after termination of application of said sustaining pulse voltage to one of said scanning electrodes and said sustaining electrodes, said sustaining pulse voltage is applied to the other.

2. A method for driving an AC-type plasma display panel comprising:

a first insulation substrate having at least one pair of scanning electrodes and sustaining electrodes which are covered with a dielectric layer and a protective layer, and a second insulation substrate arranged in opposed relationship to said first insulation substrate, having data electrodes orthogonal to said scanning electrodes and said sustaining electrodes, wherein, in sustaining discharge operation for sustaining display discharge by applying alternately a sustaining pulse voltage to said scanning electrodes and said sustaining electrodes, after termination of application of said sustaining pulse voltage to one of said scanning electrodes and sustaining electrodes, said sustaining pulse voltage is applied to the other within a time period ranging from more than about zero to about 0.3 microseconds.

* * * * *